US012516455B2

(12) United States Patent
Lin et al.

(10) Patent No.: US 12,516,455 B2
(45) Date of Patent: Jan. 6, 2026

(54) FREE CUT WARP-KNITTED FABRIC AND USE THEREOF

(71) Applicants: TORAY FIBERS & TEXTILES RESEARCH LABORATORIES (CHINA) CO., LTD., Jiangsu (CN); TORAY INDUSTRIES (H.K.) LTD., Hong Kong (CN)

(72) Inventors: Jiameng Lin, Jiangsu (CN); Hongjuan Li, Jiangsu (CN); Qing Zhang, Jiangsu (CN); Lianru Geng, Jiangsu (CN); Wenlin Qu, Jiangsu (CN)

(73) Assignees: TORAY FIBERS & TEXTILES RESEARCH LABORATORIES (CHINA) CO ., LTD., Nantong (CN); TORAY INDUSTRIES (H.K.) LTD., Hong Kong (HK)

( * ) Notice: Subject to any disclaimer, the term of this patent is extended or adjusted under 35 U.S.C. 154(b) by 0 days.

(21) Appl. No.: 18/286,610

(22) PCT Filed: Mar. 31, 2022

(86) PCT No.: PCT/CN2022/084335
§ 371 (c)(1),
(2) Date: Oct. 12, 2023

(87) PCT Pub. No.: WO2022/218162
PCT Pub. Date: Oct. 20, 2022

(65) Prior Publication Data

US 2024/0384450 A1 Nov. 21, 2024

(30) Foreign Application Priority Data

Apr. 13, 2021 (CN) ..... 202110391605.8

(51) Int. Cl.

| | |
|---|---|
| ***D04B 21/16*** | (2006.01) |
| ***D01F 8/14*** | (2006.01) |
| *D02G 1/02* | (2006.01) |
| *D04B 21/06* | (2006.01) |
| *D04B 21/20* | (2006.01) |

(52) U.S. Cl.
CPC ..... *D04B 21/16* (2013.01); *D01F 8/14* (2013.01); *D02G 1/0206* (2013.01); *D04B 21/06* (2013.01); *D04B 21/202* (2013.01); *D10B 2331/04* (2013.01); *D10B 2501/00* (2013.01)

(58) Field of Classification Search
CPC ..... D04B 21/16; D04B 21/202; D04B 21/06; D01F 8/14; D02G 1/0206; D10B 2331/04; D10B 2501/00
USPC ..... 66/171, 195, 202
See application file for complete search history.

(56) References Cited

U.S. PATENT DOCUMENTS

| | | | | | |
|---|---|---|---|---|---|
| 3,658,634 | A * | 4/1972 | Yanagi | D01F 8/14 | 428/394 |
| 3,945,052 | A * | 3/1976 | Liebig | A61F 2/06 | 600/36 |
| 4,044,575 | A * | 8/1977 | Krug | D04B 21/18 | 66/190 |
| 4,052,866 | A * | 10/1977 | Saunders | D04B 21/18 | 222/105 |
| 4,881,383 | A * | 11/1989 | Spillane | D04B 21/16 | 66/194 |
| 5,542,269 | A * | 8/1996 | Richards | D04B 21/18 | 66/195 |
| 5,591,525 | A * | 1/1997 | Keller | D01F 6/60 | 428/374 |
| 5,855,124 | A * | 1/1999 | Donaghy | D04B 21/18 | 450/40 |
| 6,615,618 | B2 * | 9/2003 | Kost | D04B 21/14 | 442/305 |
| 6,651,296 | B2 * | 11/2003 | Matsuda | D04B 21/16 | 66/193 |

(Continued)

FOREIGN PATENT DOCUMENTS

| | | | |
|---|---|---|---|
| CH | 608 529 | A5 | 1/1979 |
| CN | 202744760 | U | 2/2013 |

(Continued)

OTHER PUBLICATIONS

Complete Textile Glossary by Celanese Acetate LLC, 2001 (Year: 2001).*

(Continued)

*Primary Examiner* — Alissa J Tompkins
*Assistant Examiner* — Dakota Marin
(74) *Attorney, Agent, or Firm* — Buchanan Ingersoll & Rooney PC

(57) ABSTRACT

The present invention discloses a free-cut warp-knitted fabric and use thereof. The warp-knitted fabric is at least knitted using a yarn of a front guide bar and a yarn of a back guide bar, wherein the yarn of the front guide bar and/or the yarn of the back guide bar is a crimped fiber having a stretch elongation of 30% to 120% and a stretch recovery not less than 15%, and an underlap formed by the yarn of the front guide bar and an underlap formed by the yarn of the back guide bar have opposite directions in the same course. The warp-knitted fabric of the present invention has proper elongation and stretchability, and has good washing durability; and the fabric after cutting has raveled edges, is not easy to curl in the horizontal direction, has good wearing comfort, and can be widely used to fabricate various garments.

10 Claims, No Drawings

(56) References Cited

U.S. PATENT DOCUMENTS

| | | | | |
|---|---|---|---|---|
| 6,668,598 | B2 * | 12/2003 | Miyake | D04B 21/16 66/195 |
| 6,837,078 | B1 * | 1/2005 | Rock | D04B 21/04 66/195 |
| 6,845,639 | B1 * | 1/2005 | Hajek | A44B 18/0034 66/195 |
| 6,939,372 | B2 * | 9/2005 | Dong | A61F 2/07 623/1.13 |
| 7,240,522 | B2 * | 7/2007 | Kondou | D04B 15/48 66/195 |
| 7,364,587 | B2 * | 4/2008 | Dong | D04B 21/205 66/195 |
| 8,772,187 | B2 * | 7/2014 | Ugbolue | D04B 21/12 602/44 |
| 9,279,201 | B2 * | 3/2016 | Akita | D04B 21/18 |
| 2012/0297840 | A1 * | 11/2012 | Yeung | D04B 21/18 66/195 |
| 2016/0040328 | A1 * | 2/2016 | Yoshida | D04B 1/18 66/193 |
| 2016/0138203 | A1 * | 5/2016 | Akita | D04B 1/18 66/202 |
| 2018/0002839 | A1 * | 1/2018 | Liao | D03D 1/00 |
| 2020/0190713 | A1 * | 6/2020 | Taniguchi | D04B 21/06 |
| 2020/0291556 | A1 * | 9/2020 | Peng | D04B 21/20 |
| 2020/0362488 | A1 | 11/2020 | Liang | |
| 2021/0254277 | A1 * | 8/2021 | Kawamura | D04B 21/06 |

FOREIGN PATENT DOCUMENTS

| | | | | |
|---|---|---|---|---|
| CN | 104342802 | A * | 2/2015 | D01D 5/32 |
| CN | 109881350 | A | 6/2019 | |
| CN | 110042551 | A | 7/2019 | |
| EP | 1 403 411 | A1 | 3/2004 | |
| EP | 2 949 799 | A1 | 12/2015 | |
| JP | 2006-257588 | A | 9/2006 | |
| JP | 2018123450 | A | 8/2018 | |
| JP | 2020051008 | A | 4/2020 | |
| JP | 2020-190062 | A | 11/2020 | |

OTHER PUBLICATIONS

English Translation of CN104342802A (Year: 2013).*

International Search Report and Written Opinion for International Application No. PCT/CN2022/084335, dated Jun. 28, 2022, 5 pages.

Office Action (Notice of Reasons for Refusal) issued Oct. 15, 2024, by the Japan Patent Office in corresponding Japanese Patent Application No. 2023-562542 and an English translation of the Office Action. (7 pages).

Extended European Search Report issued Mar. 24, 2025, by the European Patent Office in corresponding European Patent Application 22787389.0-1017. (9 pages).

* cited by examiner

FREE CUT WARP-KNITTED FABRIC AND USE THEREOF

CROSS-REFERENCE TO RELATED APPLICATIONS

This application is the national phase of International Application No. PCT/CN2022/084335, filed on Mar. 31, 2022, which claims the benefit of priority to Chinese Patent Application No. 202110391605.8, filed on Apr. 13, 2021 with China National Intellectual Property Administration, and entitled "FREE-CUT WARP-KNITTED FABRIC AND USE THEREOF", the entire disclosures of each of these applications being incorporated herein by reference in their entireties for all purposes.

FIELD OF THE INVENTION

The present invention relates to a free-cut warp-knitted fabric and a garment made using the fabric.

BACKGROUND OF THE INVENTION

With the improvement of living standards, people have higher and higher requirements on the quality of garments. When a fabric is cut to fabricate a garment, often an anti-unraveling treatment, such as overlocking, needs to be performed on edges of the cut fabric. However, these treatments may affect a skin feeling more or less, and reduce wearing comfort.

In order to improve wearing comfort, fabrics requiring no special treatment on edges have been developed. For example, Japanese patent document laid-open no. 2020-51008 discloses a warp-knitted fabric having free-cutting properties, and specifically discloses: a crimped fiber having a stretch elongation of 20% to 150% and a stretch recovery of 15% to 100% is used to perform knitting on two or more guide bars, yarns of a front guide bar and a back guide bar form loops on all loop courses, the underlap formed by front guide bar yarns and back guide bar yarns have the same direction in the same course, and the ratio of the stretch elongation of the front guide bar yarns to the stretch elongation of the back guide bar yarns is 0.1 to 1.1; although the obtained fabric does not contain spandex, it still has proper elongation and stretchability, and during cutting, edges of the fabric are not easy to unravel. However, the fabric is easy to curl in the horizontal direction after cutting, and is difficult to stitch.

For another example, Chinese patent document CN202744760U discloses an anti-unraveling fabric not being easy to curl, and specifically discloses: a fabric body comprises two yarns interwoven by a warp knitting process, the two yarns include a first yarn of which the raw material is 20-D spandex yarn and a second yarn of which the raw material is a fully-matte 20-D/17-F polyamide yarn, and both the first yarn and the second yarn have a tricot stitch structure, which effectively avoids curling and unraveling caused during cutting. However, as spandex has strong stretchability, the density of the fabric becomes higher, the grammage becomes larger, and the wearing comfort becomes poorer. In addition, as spandex would ne embrittled due to embrittlement, the durability of the fabric is not good.

SUMMARY OF THE INVENTION

In view of the described problems, an object of the present invention is to provide a free-cut warp-knitted fabric which can be cut without unraveling and horizontal curling and has excellent washing durability, and use thereof.

The technical solution according to various embodiments of the present invention is:

The warp-knitted fabric according to embodiments of the present invention is at least knitted using a yarn of a front guide bar and a yarn of a back guide bar, wherein the yarn of the front guide bar and/or the yarn of the back guide bar is a crimped fiber having a stretch elongation of 30% to 120% and a stretch recovery not less than 15%, and an underlap formed by the yarn of the front guide bar and an underlap formed by the yarn of the back guide bar have opposite directions in the same course.

The free-cut warp-knitted fabric according to embodiments of the present invention has proper elongation and stretchability even no spandex is used, does not require sewing threads to be sewed in edges, and has good washing durability; in addition, the cut fabric has the characteristics of raveled edges and being not easy to curl in the horizontal direction, has good wearing comfort, and can be widely used to make various garments.

DETAILED DESCRIPTION OF EMBODIMENTS OF THE INVENTION

The fabric according to embodiments of the present invention is at least knitted using a yarn of a front guide bar and a yarn of a back guide bar, wherein the yarn of the front guide bar and/or the yarn of the back guide bar is a crimped fiber having a stretch elongation of 30% to 120% and a stretch recovery not less than 15%, and an underlap formed by the yarn of the front guide bar and an underlap formed by the yarn of the back guide bar have opposite directions in the same course.

When only a front guide bar or a back guide bar is used for knitting, although the fabric has good stretchability, the fabric is too thin, and the binding force between yarns is relatively small, and the fabric is easy to unravel; thus, it is required that the fabric according to embodiments of the present invention is at least knitted using a yarn of a front guide bar and a yarn of a back guide bar.

In an embodiment of the present invention, the crimped fiber is crimped in a humid environment in a dyeing and processing process, so that the stretchability and stretch recovery of the fabric are improved; moreover, the portions other than the overlapping portions of the loops of the front and back guide bars are not bound by the loops and can contract freely, so that the loops are arranged more tightly; and even at edges after cutting, the yarns are difficult to unravel therefrom.

The crimped fiber has a stretch elongation of 30% to 120%, preferably 40% to 110%. If the stretch elongation of the crimped fiber is less than 30%, after loops are formed by knitting, gaps are likely to appear on the fabric due to insufficient bulk feeling of yarns; moreover, the area differences of the appearance between an overlapping portion and a non-overlapping free portion of a loop is reduced, and thus the loops at edges after cutting are easy to unravel. In addition, the higher the stretch elongation of yarns, the better the bulkiness, the tighter the structure of the fabric, and the more difficult it is to unravel at the edges after cutting; however, when the stretch elongation is more than 120%, the fabric becomes thicker and heavier, and the wearing and usage performance of the fabric is reduced.

In order to ensure the recovery of the fabric, provide a proper close-to-skin feeling, and ensure the integrity of filaments after cutting, the present invention according to an embodiment requires the described crimped fiber to have a stretch recovery not less than 15%, preferably not less than 25%.

In embodiments of the present invention, if a weft knitted structure is used, although the stretchability of the fabric would be improved, as all loops are in an open state, the stitch is relatively loose, the yarns at a cut position are easy to unravel, and curling is easy to occur. If a woven structure is used, although the problem of fabric curling would not occur, as the yarns do not ravel together, the yarns at a cut position are easy to unravel, and the fabric lacks stretchability. Thus, the fabric according to an embodiment of the present invention has a warp-knitted stitch. The warp-knitted stitch in the present invention is not particularly limited, as long as the stitches in the same course are in opposite directions; and the loops can be any combination of open loops and closed loops, but preferably the yarn of the front guide bar form closed loops and the yarn of the back guide bar form open loops, so as to better solve the problem of curling of the fabric in the horizontal direction.

In embodiments of the present invention, the yarn of the front guide bar and the yarn of the back guide bar form loops together on all paths, so that the loops are tight and are not easy to unravel. If only one guide bar is used for yarns forming loops, the binding force of the loops is weak, and as the length of a top arc increases, the yarns are not bound and are easy to unravel during cutting. In embodiments of the present invention, the underlap formed by the yarn of the front guide bar and the underlap formed by the yarn of the back guide bar have opposite directions in the same course, wherein the term "same course" refers to the same horizontal row in the stitch structure, and the term "opposite" means that the underlap formed by the yarn of the front guide bar and the underlap formed by the back bar cross each other in the same course. If the underlap formed by the yarn of the front guide bar and the underlap formed by the back bar have the same direction in the same course, that is, the underlap formed by the yarn of the front guide bar is parallel or approximately parallel to the underlap formed by the yarn of the back guide bar, the internal stress of the fabric is unbalanced, the edges are easy to curl, and the problem of horizontal curling occurs.

The raw materials of the crimped fiber in the present invention are not particularly limited, and may be a single-component fiber, or a double-component composite fiber, and preferably a double-component composite fiber. Specific examples include polytrimethylene terephthalate single-component fiber (PTT), polybutylene terephthalate single-component fiber (PBT), high-viscosity polyethylene terephthalate/low viscosity polyethylene terephthalate double-component composite fiber (PET/PET), polytrimethylene terephthalate/polyethylene terephthalate double-component composite fiber (PTT/PET), polybutylene terephthalate/polyethylene terephthalate double-component composite fiber (PBT/PET), polyamide 6 (NY6), polyamide 66 (NY66), polyamide 610 (NY610), polyamide 6/polyamide 66 (NY6/NY66), polyamide 66/polyamide 610 (NY66/NY610), and the like. A double-component composite fiber may be a side-by-side composite fiber or a sheath-core composite fiber. Considering that the side-by-side composite fiber has good crimping properties, can better ensure the stability of the structure at cut edges, and improves anti-unraveling properties, the side-by-side composite fiber is more preferable.

In embodiments of the present invention, if the ratio of the stretch elongation of the yarn of the front guide bar to the stretch elongation of the yarn of the back guide bar is more than 1.1, the elongation of the fabric tends to decrease, and edge curling incidence tends to increase. If the ratio of the stretch elongation of the yarn of the front guide bar to the stretch elongation of the yarn of the back guide bar is less than 0.1, the elasticity difference between the yarn of the front guide bar and the yarn of back guide bar is large, and the problem of wrinkling due to imbalanced stress may occur on the fabric surface; thus, in embodiments of the present invention, the ratio of the stretch elongation of the yarn of the front guide bar to the stretch elongation of the yarn of the back guide bar preferably ranges from 0.1 to 1.1, and more preferably ranges from 0.2 to 1.0.

In embodiments of the present invention, preferably, the front guide bar is a tricot stitch, and the back guide bar is a tricot stitch or cord stitch; more preferably, the front guide bar is a tricot stitch, and the back guide bar is a cord stitch. The front guide bar is a tricot stitch, so that the fabric is easier to stretch, and when the front guide bar uses two needles to move horizontally, yarns on the needles overlap together, so that the fabric has more stable tearing strength and a soft hand feeling. In addition, the back guide bar is a cord stitch, so that a stable ground stitch can be formed with less yarns. If the back guide bar is a tricot stitch where two needles are moved horizontally, the fabric tends to thicken.

In embodiments of the present invention, the fabric has a warp density (the number of loop courses in the warp direction) of 60 to 120 pieces/inch and a weft density (the number of loop wales in the horizontal direction) of 50 to 80 pieces/inch. If the warp density and the weft density are not within the described ranges, as the yarns become longer, the portion of the yarns at cut edges not bound becomes larger, and dropped stitch becomes easier to occur. In contrast, the higher the density of the fabric, the more difficult it is for the cross section of a cut edge to drop, and correspondingly the fabric becomes thicker and heavier. Preferably, the warp density is 80 to 100 pieces/inch and the weft density is 60 to 70 pieces/inch.

Preferably, the fabric according to embodiments of the present invention has a basis weight of 80 to 150 g/m$^2$. When the basis weight of the fabric is more than 150 g/m$^2$, the fabric tends to thicken, which may affect the wearing comfort.

In view of the fact that although edge treatment can improve the unraveling properties, the treatment also makes edge thicker, which affects the wearing comfort, when the fabric of the present invention is used to fabric a garment, it is preferable to use the fabric as a part or all of the garment without performing edge treatment in a state where the edges of the fabric are cut.

The present invention is further described below with reference to examples and comparative examples.

The testing methods for all parameters involved in the present invention are as follows:

(1) Stretch elongation and stretch recovery of a yarn of a front/back guide bar measured according to the JIS L 1013:2010 A method.

(2) Elongation and elongation recovery of a fabric measured according to the JIS L 1096:2010 D method (fixed load), the load being 490.4cN.

(3) basis weight measured according to the JIS L 1096: 2010 method.

(4) warp density and weft density

The surface of a fabric was observed using a sewing magnifying glass (Changzhou Depu Textile Technology Co. Ltd., Model Y511C), and the number of loops of the fabric in the warp direction within 1 inch (warp density) and the number of loops of the fabric in the horizontal direction within 1 inch (weft density) were read.

(5) Unraveling properties of a cut fabric

A test sample cloth having a vertical width of 5.5 cm and a horizontal length of 42 cm was obtained by cutting a fabric; two incisions having a length of 3 cm were made by cutting the fabric in the horizontal direction at an angle of 45° on one side in the reverse direction of the knitting direction, and three incisions having a length of 3 cm were made by cutting the fabric in the horizontal direction at an angle of 45° on one side in the knitting direction; the left and right ends of the sample cloth in the vertical direction are sewn; and after being washed on the basis of the JIS L 0217 103:1995 method, the sample cloth was spun and dried, and damage evaluation was performed on the incision parts of the fabric. Damage of the incision parts was evaluated on the basis of the quantity and length of the fibers dropped and the cracks at the incision parts. The appearance damage evaluation was performed in the following ten grades. 7 or below is qualified, and 8 or above is unqualified. Determination was made for the horizontal direction (90°) and the oblique direction (45°) of the knitting direction and the reverse direction of the knitting direction. Then, the determination values of the horizontal direction (90°) and the oblique direction (45°) were averaged for evaluation. Evaluation was made for the five incisions on one sample cloth and the values are averaged.

Evaluation Standards

10: there is only one part unraveled, and the length of the unraveled part more than 2 mm 9: there is only one part unraveled, and the length of the unraveled part is 1 to 2 mm 8: there are ten or more unraveled parts having a length not less than 0.8 mm but less than 1 mm 7: there are seven to nine unraveled parts having a length not less than 0.8 mm but less than 1 mm 6: there are four to six unraveled parts having a length not less than 0.8 mm but less than 1 mm 5: there are three or less unraveled parts having a length not less than 0.8 mm but less than 1 mm 4: there is only one part unraveled, and the length of the unraveled part is not less than 0.6 mm but less than 0.8 mm 3: there is only one part unraveled, and the length of the unraveled part is not less than 0.3 mm but less than 0.6 mm 2: there is only one part unraveled, and the length of the unraveled part is less than 0.3 mm 1: there is no unraveled part.

(6) Curling of a cut fabric

Three sample cloths having a width of 25 mm and a length of 160 mm were obtained by cutting a fabric. One of the cloths was taken, reference is made to the JIS L1096:2010 H-2 method to use steam to treat the flat sample cloth for 15 seconds during which no air suction operation was performed, then the treated sample cloth was placed in a flat place in parallel, the minimum projection width L1 (mm) of a curled part was measured when light is irradiated from right above, and horizontal curling (%) was calculated using the following calculation formula:

$$\text{Curling } (\%) = (25 - L1)/25 \times 100\%.$$

The horizontal curling of the remaining two cloths was measured and calculated according to the same method, and the values are averaged to serve as the curling of the cut fabric according to embodiments of the present invention.

Example 1

In a E28 KARL MAYER warp knitting machine, side-by-side PBT/PET false-twist textured yarn of 33 dtex/24f (a stretch elongation of 87%, and a stretch recovery of 25%) was selected for both a front guide bar and a back guide bar, both the front guide bar and the back guide bar were tricot stitches, and the directions were opposite in the same course; a greige fabric having a warp density of 56 pieces/inch and a weft density of 43 pieces/inch was obtained by knitting; and the greige fabric was pre-heated (160° C.×1 min)→scoured (2 g/L of a scouring agent)→dyed (Disperse dye amount being 3% o.w.f, 130° C.×30 min)→processed by a soft resin (silicone oil)→sized (160° C.×1 min), so as to obtain the warp-knitted fabric according to an embodiment of the present invention. The specific parameters are shown in Table 1.

Example 2

The side-by-side PBT/PET false-twist textured yarn of 33 dtex/24f was replaced with PBT false-twist textured yarn of 60 dtex/24f (a stretch elongation of 72%, and a stretch recovery of 22%), and the rest was the same as Example 1, so as to obtain the warp-knitted fabric according to an embodiment of the present invention. The specific parameters are shown in Table 1.

Example 3

The yarn of the back guide bar was replaced with PBT false-twist textured yarn of 44 dtex/24f (a stretch elongation of 72%, and a stretch recovery of 22%), and the rest was the same as Example 1, so as to obtain the warp-knitted fabric according to an embodiment of the present invention. The specific parameters are shown in Table 1.

Example 4

The back guide bar was adjusted into a cord stitch, and the rest was the same as Example 1, so as to obtain the warp-knitted fabric according to an embodiment of the present invention. The specific parameters are shown in Table 1.

Example 5

The greige fabric had a warp density of 33 pieces/inch and a weft density of 29 pieces/inch, and the rest was the same as Example 1, so as to obtain the warp-knitted fabric according to an embodiment of the present invention. The specific parameters are shown in Table 1.

Example 6

Three guide bars were used for knitting, the middle guide bar used side-by-side PBT/PET false-twist textured yarn of 33 dtex/24f (a stretch elongation of 87%, and a stretch recovery of 25%) and had a tricot stitch, and the rest was the same as Example 1, so as to obtain the warp-knitted fabric according to an embodiment of the present invention. The specific parameters are shown in Table 1.

Example 7

The side-by-side PBT/PET false-twist textured yarn of 33 dtex/24f was replaced with PET high-elasticity false-twist textured yarn of 50 dtex/36f (a stretch elongation of 48%, and a stretch elongation of 29%), the greige fabric had a warp density of 45 pieces/inch and a weft density of 40 pieces/inch, and the rest was the same as Example 1, so as to obtain the warp-knitted fabric according to an embodiment of the present invention. The specific parameters are shown in Table 1.

Example 8

The side-by-side PBT/PET false-twist textured yarn of 33 dtex/24f were replaced with side-by-side PTT/PET false-twist textured yarn of 50 dtex/48f (a stretch elongation of 102%, and a stretch recovery of 93%), the warp density of the greige fabric was adjusted to 78 pieces/inch, and the weft density of the greige fabric was adjusted to 66 pieces/inch, and the rest was the same as Example 1, so as to obtain the warp-knitted fabric according to an embodiment of the present invention. The Specific Parameters are Shown in Table 1.

Example 9

The yarn of the back guide bar was replaced with normal PET high-elasticity false-twist textured yarn of 50 dtex/36f (a stretch elongation of 48%, and a stretch recovery of 29%), the warp density of the greige fabric was adjusted to 56 pieces/inch, and the weft density of the greige fabric was adjusted to 45 pieces/inch, and the rest was the same as Example 1, so as to obtain the warp-knitted fabric according to an embodiment of the present invention. The specific parameters are shown in Table 1.

Example 10

The yarn of the front guide bar was replaced with normal PET high-elasticity false-twist textured yarn of 40 dtex/24f (a stretch elongation of 48%, and a stretch recovery of 29%), and the rest was the same as Example 1, so as to obtain the warp-knitted fabric according to an embodiment of the present invention. The specific parameters are shown in Table 1.

Example 11

The side-by-side PBT/PET false-twist textured yarn of 33 dtex/24f was replaced with side-by-side NY6/NY66 false-twist textured yarn of 56 dtex/24f (a stretch elongation of 78%, and a stretch recovery of 45%), and the rest was the same as Example 1, so as to obtain the warp-knitted fabric according to an embodiment of the present invention. The specific parameters are shown in Table 1.

A garment without any edge treatment after cutting was fabricated from the warp-knitted fabric of Examples 1-11.

Comparative Example 1

Both the front guide bar and the back guide bar used side-by-side PBT/PET false-twist textured yarn of 33 dtex/36f, both the front guide bar and the back guide bar were tricot stitches, the underlaps of the front guide bar and the rear guide bar had the same direction, and the rest was same as Example 1, so as to obtain a warp-knitted fabric. The specific parameters are shown in Table 1.

Comparative Example 2

The side-by-side PBT/PET false-twist textured yarn of 33 dtex/24f was replaced with normal PET false-twist textured yarn of 50 dtex/24f (a stretch elongation of 25%, and a stretch recovery of 18%), and the rest was the same as Example 1, so as to obtain a warp-knitted fabric. The specific parameters are shown in Table 1.

TABLE 1

| | | Example 1 | Example 2 | Example 3 | Example 4 | Example 5 | Example 6 | Example 7 |
|---|---|---|---|---|---|---|---|---|
| Front guide bar | Stretch elongation % | 87 | 72 | 87 | 87 | 87 | 87 | 48 |
| | Stretch recovery % | 25 | 22 | 25 | 25 | 25 | 25 | 29 |
| | Category | PBT/PET | PBT | PBT/PET | PBT/PET | PBT/PET | PBT/PET | PET |
| Back guide bar | Stretch elongation % | 87 | 72 | 72 | 87 | 87 | 87 | 48 |
| | Stretch recovery % | 25 | 22 | 22 | 25 | 25 | 25 | 29 |
| | Category | PBT/PET | PBT | PBT | PBT/PET | PBT/PET | PBT/PET | PET |
| Middle guide bar | Stretch elongation % | — | — | — | — | — | 87 | |
| | Stretch recovery % | — | — | — | — | — | 25 | |
| | Category | — | — | — | — | — | PBT/PET | |
| Ratio of stretch elongations of front and back guide bar yarns | | 1.0 | 1.0 | 1.2 | 1.0 | 1.0 | 1.0 | 1.0 |
| Kitting stitch | Front guide bar | Tricot stitch | Tricot stitch | Tricot stitch | Tricot stitch | Tricot stitch | Tricot stitch | Tricot stitch |
| | Back guide bar | Tricot stitch | Tricot stitch | Tricot stitch | Cord stitch | Tricot stitch | Tricot stitch | Tricot stitch |
| | Direction | Opposite | Opposite | Opposite | Opposite | Opposite | Opposite | Opposite |
| Finished product density (piece/inch) | Warp density | 76 | 75 | 76 | 76 | 52 | 76 | 62 |
| | Weft density | 55 | 55 | 55 | 56 | 41 | 55 | 51 |

TABLE 1-continued

| | | | | | | | |
|---|---|---|---|---|---|---|---|
| Grammage (g/m$^2$) | | 105 | 125 | 110 | 105 | 85 | 136 | 120 |
| Curling (%) | | 18 | 22 | 26 | 38 | 46 | 25 | 36 |
| Unraveling properties | | 2 | 3 | 2 | 4 | 6 | 2 | 7 |

| | | Example 8 | Example 9 | Example 10 | Example 11 | Comparative example 1 | Comparative example 2 |
|---|---|---|---|---|---|---|---|
| Front guide bar | Stretch elongation % | 102 | 87 | 48 | 78 | 87 | 25 |
| | Stretch recovery % | 93 | 25 | 29 | 45 | 25 | 18 |
| | Category | PTT/PET | PBT/PET | PET | NY6/NY66 | PBT/PET | PET |
| Back guide bar | Stretch elongation % | 102 | 48 | 87 | 78 | 87 | 25 |
| | Stretch recovery % | 93 | 29 | 25 | 45 | 25 | 18 |
| | Category | PTT/PET | PET | PBT/PET | NY6/NY66 | PBT/PET | PET |
| Middle guide bar | Stretch elongation % | | — | — | — | — | — |
| | Stretch recovery % | | — | — | — | — | — |
| | Category | | — | — | — | — | — |
| Ratio of stretch elongations of front and back guide bar yarns | | 1.0 | 1.8 | 0.6 | 1.0 | 1.0 | 1.0 |
| Kitting stitch | Front guide bar | Tricot stitch | Tricot stitch | Tricot stitch | Tricot stitch | Tricot stitch | Tricot stitch |
| | Back guide bar | Tricot stitch | Tricot stitch | Tricot stitch | Tricot stitch | Tricot stitch | Tricot stitch |
| | Direction | Opposite | Opposite | Opposite | Opposite | Same | Opposite |
| Finished product density (piece/inch) | Warp density | 96 | 76 | 76 | 78 | 76 | 76 |
| | Weft density | 78 | 56 | 56 | 56 | 55 | 55 |
| Grammage (g/m$^2$) | | 130 | 120 | 115 | 118 | 103 | 120 |
| Curling (%) | | 32 | 39 | 38 | 29 | 95 | 89 |
| Unraveling properties | | 5 | 7 | 7 | 5 | 9 | 10 |

According to Table 1

(1) It can be determined from Example 1 and Example 2 that, under the same conditions, the warp-knitted fabric obtained by using the PBT/PET yarn on the front and back guide bars and the warp-knitted fabric obtained by using the PBT yarn on the front and back guide bars are compared, the former has horizontal curling smaller than that of the latter and an unraveling property determination value smaller than that of the latter, that is, both the horizontal curling properties and the anti-unraveling properties are better than those of the latter.

(2) It can be determined from Example 1 and Example 3 that, under the same conditions, the warp-knitted fabric of which the ratio of the stretch elongations of the front and back guide bar yarns is 1.2 and the warp-knitted fabric of which the ratio of the stretch elongations of the front and back guide bar yarns is 1.0 are compared, the horizontal curling of the former is smaller than that of the latter, and the unraveling property determination values of the two are equivalent, that is, the horizontal curling properties of the former are better than those of the latter.

(3) It can be determined from Example 1 and Example 4 that, under the same conditions, the warp-knitted fabric formed by a back guide bar being a tricot stitch and the warp-knitted fabric formed by a back guide bar being a cord stitch are compared, the former has horizontal curling smaller than that of the latter and an unraveling property determination value smaller than that of the latter, that is, both the horizontal curling properties and the anti-unraveling properties are better than those of the latter.

(4) It can be determined from Example 1 and Example 5 that, under the same conditions, the warp-knitted fabric having a warp density of 76 pieces/inch and a weft density of 55 pieces/inch and the warp-knitted fabric having a warp density of 52 pieces/inch and a weft density of 41 pieces/inch are compared, the former has horizontal curling smaller than that of the latter and an unraveling property determination value smaller than that of the latter, that is, both the horizontal curling properties and the anti-unraveling properties are better than those of the latter.

(5) It can be determined from Comparative Example 1 and Example 1 that, under the same conditions, the warp-knitted fabric of which the knitting stitches in the same course have the same direction and the warp-knitted fabric of which the knitting stitches in the same course have different directions are compared, the former has greater horizontal curling and a greater unraveling determination value, that is, both the horizontal curling properties and the anti-unraveling properties of the former are poorer.

(6) It can be determined from Comparative Example 2 and Example 1 that, under the same conditions, the warp-knitted fabric obtained by using the normal PET yarn (a stretch elongation of 25%, and a stretch recovery of 18%) and the warp-knitted fabric obtained by using the PBT/PET yarn (a stretch elongation of 87%, and a stretch recovery of 25%) are compared, the former has greater horizontal curling and a greater unraveling determination value, that is, both the horizontal curling properties and the anti-unraveling properties of the former are poorer.

What is claimed is:

1. A free-cut warp-knitted fabric, being at least knitted using a yarn of a front guide bar and a yarn of a back guide bar, wherein the yarn of the front guide bar and/or the yarn of the back guide bar comprises: a crimped fiber having a stretch elongation of 30% to 120% and a stretch recovery not less than 15%, and an underlap formed by the yarn of the front guide bar and an underlap formed by the yarn of the back guide bar both have opposite directions in the same course, and wherein the crimped fiber is a double-component composite fiber, and the double-component composite fiber is high-viscosity polyethylene terephthalate/low viscosity polyethylene terephthalate double-component composite fiber (PET/PET), polytrimethylene terephthalate/polyethylene terephthalate double-component composite fiber (PTT/PET), polybutylene terephthalate/polyethylene terephthalate double-component composite fiber (PBT/PET), polyamide 6/polyamide 66 (NY6/NY66), or polyamide 66/polyamide 610 (NY66/NY610), and wherein the warp-knitted fabric does not require any edge treatment after cutting.

2. The free-cut warp-knitted fabric according to claim 1, wherein the ratio of the stretch elongation of the yarn of the front guide bar to the stretch elongation of the yarn of the back guide bar ranges from 0.1 to 1.1.

3. The free-cut warp-knitted fabric according to claim 1, wherein the front guide bar is a tricot stitch, and the back guide bar is a tricot stitch or cord stitch.

4. The free-cut warp-knitted fabric according to claim 1, wherein the warp-knitted fabric has a warp density of 60 to 120 pieces/inch and a weft density of 50 to 80 pieces/inch.

5. The free-cut warp-knitted fabric according to claim 1, wherein the warp-knitted fabric has a basis weight of 80 to 150 g/m2.

6. A garment fabricated using the free-cut warp-knitted fabric according to claim 1.

7. A garment fabricated using the free-cut warp-knitted fabric according to claim 2.

8. A garment fabricated using the free-cut warp-knitted fabric according to claim 3.

9. A garment fabricated using the free-cut warp-knitted fabric according to claim 4.

10. A garment fabricated using the free-cut warp-knitted fabric according to claim 5.

* * * * *